US011070933B1

(12) United States Patent
Schroeder et al.

(10) Patent No.: US 11,070,933 B1
(45) Date of Patent: Jul. 20, 2021

(54) REAL-TIME ACOUSTIC SIMULATION OF EDGE DIFFRACTION

(71) Applicant: Apple Inc., Cupertino, CA (US)

(72) Inventors: Dirk Schroeder, San Jose, CA (US); Jonathan D. Sheaffer, San Jose, CA (US); Soenke Pelzer, San Jose, CA (US); Juha O. Merimaa, San Mateo, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 16/942,680

(22) Filed: Jul. 29, 2020

Related U.S. Application Data

(60) Provisional application No. 62/883,435, filed on Aug. 6, 2019.

(51) Int. Cl.

| | |
|---|---|
| ***H04S 7/00*** | (2006.01) |
| ***H04R 3/04*** | (2006.01) |
| ***H04R 5/033*** | (2006.01) |
| ***H04S 1/00*** | (2006.01) |
| ***H04R 5/04*** | (2006.01) |

(52) U.S. Cl.
CPC ..... *H04S 7/304* (2013.01); *H04R 3/04* (2013.01); *H04R 5/033* (2013.01); *H04R 5/04* (2013.01); *H04S 1/007* (2013.01); *H04R 2499/15* (2013.01); *H04S 2400/11* (2013.01); *H04S 2420/01* (2013.01)

(58) Field of Classification Search
CPC ..... H04S 1/007; H04S 3/006; H04S 3/008; H04S 7/304; H04S 2400/11; H04S 2420/01; H04R 3/04; H04R 5/02; H04R 5/033; H04R 5/04; H04R 2499/15; A63F 2300/6063; G06F 3/165
USPC ..... 381/303, 309, 310; 700/94; 463/35
See application file for complete search history.

(56) References Cited

U.S. PATENT DOCUMENTS 7,928,311 B2 * 4/2011 Trivi ..... G10H 1/0066 84/645
8,488,796 B2 * 7/2013 Jot ..... H04S 5/00 381/17

(Continued)

OTHER PUBLICATIONS

Paul Thomas Calamia, "Advances in Edge-Diffraction Modeling for Virtual-Acoustic Simulations", A Dissertation Presented to the Faculty of Princeton University in Candidacy for the Degree of Doctor of Philosophy, Jun. 2009.

*Primary Examiner* — Xu Mei
(74) *Attorney, Agent, or Firm* — Womble Bond Dickinson (US) LLP

(57) ABSTRACT

A computer system having an electronic device determines a listener position within a computer-generated reality (CGR) setting that is to be aurally experienced by a user of the electronic device through at least one speaker. The system determines a source position of a virtual sound source within the CGR setting and determines a characteristic of a virtual object within the CGR setting, where the characteristic include a geometry of an edge of the virtual object. The system determines at least one edge-diffraction filter parameter for an edge-diffraction filter based on 1) the listener position, 2) the source position, and 3) the geometry. The system applies the edge-diffraction filter to an input audio signal to produce a filtered audio signal that accounts for edge-diffraction of sound produced by the virtual sound source within the CGR setting.

26 Claims, 7 Drawing Sheets

(56) References Cited

U.S. PATENT DOCUMENTS

| | | | | |
|---|---|---|---|---|
| 9,560,439 | B2 * | 1/2017 | Mehra | H04S 7/304 |
| 9,711,126 | B2 * | 7/2017 | Mehra | A63F 13/54 |
| 10,609,485 | B2 * | 3/2020 | Nawfal | H04S 7/308 |
| 10,616,705 | B2 * | 4/2020 | Schmidt | G06F 3/011 |
| 2003/0007648 | A1 * | 1/2003 | Currell | H04S 7/305<br>381/61 |
| 2015/0378019 | A1 * | 12/2015 | Schissler | G06T 15/06<br>700/94 |
| 2018/0315432 | A1 * | 11/2018 | Boehm | G10L 19/008 |

* cited by examiner

REAL-TIME ACOUSTIC SIMULATION OF EDGE DIFFRACTION

CROSS REFERENCE TO RELATED APPLICATION

This application claims the benefit of U.S. Provisional Application No. 62/883,435 filed on Aug. 6, 2019, the disclosure of which is incorporated herein by reference in its entirety.

FIELD

An aspect of the disclosure relates to a computer system that simulates edge diffraction in a computer-generated reality (CGR) setting.

BACKGROUND

Sound is a sequence of audible waves of pressure that propagates through a transmission medium such as a gas, liquid or solid. When sound comes into contact with a surface of an object (e.g., a wall), several things may occur. For instance, a portion of the sound may reflect off the wall and back into a room at a different angle, or the sound may be absorbed by the wall. As another example, when a sound wave encounters an obstacle, the wave may bend around the corner of the obstacle. This is known as edge-diffraction.

SUMMARY

An aspect of the disclosure is a system that simulates edge-diffraction in a computer-generated reality (CGR) setting in real-time. Specifically, the system may perform edge-diffraction simulation operations in order to simulate single-edge based edge-diffraction. The system includes an electronic device, such as a head-mounted device (HMD) that is communicatively coupled to at least one speaker (e.g., a speaker of a left earphone and a speaker of a right earphone) that is configured to output sound of the CGR setting. The system determines a listener position within the CGR setting that is to be aurally experienced by a user of the electronic device through the speaker. For instance, the listener position may be an avatar through which the user participates in the CGR setting. The system determines a source position of a virtual sound source within the CGR setting. For instance, when the CGR setting is a virtual home, the virtual sound source may be a virtual radio that is playing music. The system determines a characteristic of the (e.g., virtual) object within the CGR setting, such as a geometry of an edge of the virtual object, such as an edge on (or of) a corner of a wall that protrudes into a room. The system uses a machine-learning algorithm to determine at least one edge-diffraction filter parameter for an edge-diffraction filter based on the 1) listener position, 2) the source position, and 3) the geometry. The system determines (or produces) the edge-diffraction filter (e.g., a low-pass filter) according to the edge-diffraction filter parameters and applies the edge-diffraction filter to an input audio signal associated with the virtual sound source to produce a filtered audio signal that accounts for edge diffraction of sound produced by the virtual sound source within the CGR setting.

In another aspect of the disclosure, the system simulates multi-edge based edge diffraction in the CGR setting in real-time. Specifically, the system may perform edge-diffraction simulation operations to determine edge-diffraction for a three-dimensional (3D) virtual object that has one or more edges (or sides) about which sound may be diffracted from. The system determines that the 3D virtual object is between the source position of the virtual sound source and the listener position. For instance, the virtual object is occluding a direct sound path (e.g., a straight line from the source position to the listener position). The system produces a two-dimensional (2D) image that contains a projection of the 3D virtual object on a 2D plane. For instance, the 2D image may be an image of the 3D virtual object, with the amplitude (or thickness) of the virtual object in one direction (e.g., a z-direction) set to zero. The system determines, using a ML algorithm, edge-diffraction filter parameters for an edge-diffraction filter according to the 2D image (e.g., using the 2D image as input). The system determines the edge-diffraction filter based on the edge-diffraction filter parameters and applies the filter to an input audio signal.

In another aspect of the disclosure, the system spatially renders the filtered audio signal to provide spatial audio localization cues to give the wearer of the HMD the perception that the sound is being emitted from a particular location within the CGR setting. As an example, the system may determine a spatial filter, such as a Head-Related Transfer Function (HRTFs) to be applied to the filtered signal according to a newly defined path from the listener position to the edge of the virtual object, instead of the original path from the listener to the source. The spatial filter is based on this path because the edge of the virtual object is to act as a secondary virtual sound source that is to emit the sound of the filtered audio signal into the CGR setting. The system uses the spatial filter to spatially render the filtered audio signal to produce several spatially rendered audio signals (e.g., binaural signals) that provides the localization cues when each of the signals is outputted through two or more speakers, such as speakers of the left and right earphones of a HMD.

In another aspect, at least some of the edge-diffraction simulation operations may be performed by one or more processors of one or more electronic devices that are a part of the computer system. For instance, the electronic device may be communicatively coupled with a companion device (e.g., a smartphone, a laptop, etc.) that has an established communication link, via the Internet with a remote server that performs cloud-based CGR setting operations. As an example, the electronic device may obtain CGR setting data from the remote server, via the companion device and perform the simulation operations described herein. As another example, the companion device may perform the simulation operations and transmit the spatially rendered audio signals to the electronic device for output through at least one speaker integrated therein.

The above summary does not include an exhaustive list of all aspects of the present disclosure. It is contemplated that the disclosure includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The aspects of the disclosure are illustrated by way of example and not by way of limitation in the figures of the accompanying drawings in which like references indicate similar elements. It should be noted that references to "an"

or "one" aspect of the disclosure are not necessarily to the same aspect, and they mean at least one. Also, in the interest of conciseness and reducing the total number of figures, a given figure may be used to illustrate the features of more than one aspect of the disclosure, and not all elements in the figure may be required for a given aspect.

DETAILED DESCRIPTION

Figure 1:
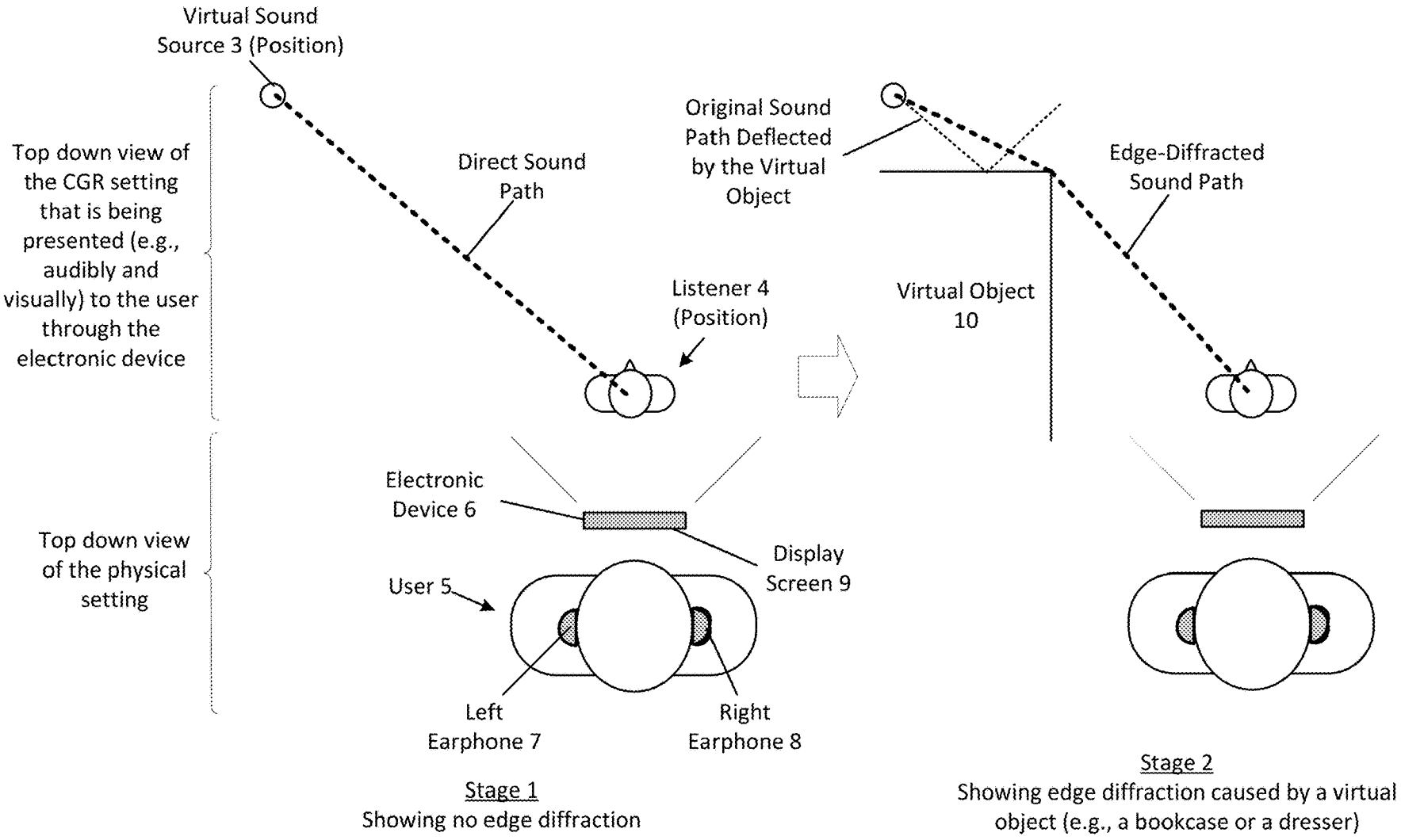
FIG. 1 shows an example of edge diffraction in a computer-generated reality (CGR) setting.

Several aspects of the disclosure with reference to the appended drawings are now explained. Whenever the shapes, relative positions, and other aspects of the parts described in the aspects are not explicitly defined, the scope of the disclosure is not limited only to the parts shown, which are meant merely for the purpose of illustration. Also, while numerous details are set forth, it is understood that some aspects of the disclosure may be practiced without these details. In other instances, well-known circuits, structures, and techniques have not been shown in detail so as not to obscure the understanding of this description. In one aspect, ranges disclosed herein may include any value (or quantity) between end point values and/or the end point values.

A physical environment (or setting) refers to a physical world that people can sense and/or interact with without aid of electronic systems. Physical environments, such as a physical park, include physical articles, such as physical trees, physical buildings, and physical people. People can directly sense and/or interact with the physical environment, such as through sight, touch, hearing, taste, and smell.

In contrast, a computer-generated reality (CGR) environment (setting) refers to a wholly or partially simulated environment that people sense and/or interact with via an electronic system. In CGR, a subset of a person's physical motions, or representations thereof, are tracked, and, in response, one or more characteristics of one or more virtual objects simulated in the CGR environment are adjusted in a manner that comports with at least one law of physics. For example, a CGR system may detect a person's head turning and, in response, adjust graphical content and an acoustic field presented to the person in a manner similar to how such views and sounds would change in a physical environment. In some situations (e.g., for accessibility reasons), adjustments to characteristic(s) of virtual object(s) in a CGR environment may be made in response to representations of physical motions (e.g., vocal commands).

A person may sense and/or interact with a CGR object using any one of their senses, including sight, sound, touch, taste, and smell. For example, a person may sense and/or interact with audio objects that create 3D or spatial audio environment that provides the perception of point audio sources in 3D space. In another example, audio objects may enable audio transparency, which selectively incorporates ambient sounds from the physical environment with or without computer-generated audio. In some CGR environments, a person may sense and/or interact only with audio objects.

Examples of CGR include virtual reality and mixed reality. A virtual reality (VR) environment refers to a simulated environment that is designed to be based entirely on computer-generated sensory inputs for one or more senses. A VR environment comprises a plurality of virtual objects with which a person may sense and/or interact. For example, computer-generated imagery of trees, buildings, and avatars representing people are examples of virtual objects. A person may sense and/or interact with virtual objects in the VR environment through a simulation of the person's presence within the computer-generated environment, and/or through a simulation of a subset of the person's physical movements within the computer-generated environment.

In contrast to a VR environment, which is designed to be based entirely on computer-generated sensory inputs, a mixed reality (MR) environment refers to a simulated environment that is designed to incorporate sensory inputs from the physical environment, or a representation thereof, in addition to including computer-generated sensory inputs (e.g., virtual objects). On a virtuality continuum, a mixed reality environment is anywhere between, but not including, a wholly physical environment at one end and virtual reality environment at the other end.

In some MR environments, computer-generated sensory inputs may respond to changes in sensory inputs from the physical environment. Also, some electronic systems for presenting an MR environment may track location and/or orientation with respect to the physical environment to enable virtual objects to interact with real (or physical) objects (that is, physical articles from the physical environment or representations thereof). For example, a system may account for movements so that a virtual tree appears stationery with respect to the physical ground.

Examples of mixed realities include augmented reality and augmented virtuality. An augmented reality (AR) environment refers to a simulated environment in which one or more virtual objects are superimposed over a physical environment, or a representation thereof. For example, an electronic system for presenting an AR environment may have a transparent or translucent display through which a person may directly view the physical environment. The system may be configured to present virtual objects on the transparent or translucent display, so that a person, using the system, perceives the virtual objects superimposed over the physical environment. Alternatively, a system may have an opaque display and one or more imaging sensors that capture images or video of the physical environment, which are representations of the physical environment. The system composites the images or video with virtual objects, and presents the composition on the opaque display. A person, using the system, indirectly views the physical environment by way of the images or video of the physical environment, and perceives the virtual objects superimposed over the physical environment. As used herein, a video of the physical environment shown on an opaque display is called "pass-through video," meaning a system uses one or more image sensor(s) to capture images of the physical environment, and uses those images in presenting the AR environment on the opaque display. Further alternatively, a system may have a projection system that projects virtual objects into the physical environment, for example, as a hologram or on a physical surface, so that a person, using the system, perceives the virtual objects superimposed over the physical environment.

An augmented reality environment also refers to a simulated environment in which a representation of a physical environment is transformed by computer-generated sensory information. For example, in providing pass-through video, a system may transform one or more sensor images to impose a select perspective (e.g., viewpoint) different than the perspective captured by the imaging sensors. As another example, a representation of a physical environment may be transformed by graphically modifying (e.g., enlarging) portions thereof, such that the modified portion may be representative but not photorealistic versions of the originally captured images. As a further example, a representation of a physical environment may be transformed by graphically eliminating or obfuscating portions thereof.

An augmented virtuality (AV) environment refers to a simulated environment in which a virtual or computer generated environment incorporates one or more sensory inputs from the physical environment. The sensory inputs may be representations of one or more characteristics of the physical environment. For example, an AV park may have virtual trees and virtual buildings, but people with faces photorealistically reproduced from images taken of physical people. As another example, a virtual object may adopt a shape or color of a physical article imaged by one or more imaging sensors. As a further example, a virtual object may adopt shadows consistent with the position of the sun in the physical environment.

There are many different types of electronic systems that enable a person to sense and/or interact with various CGR environments. Examples include head mounted systems (or head mounted devices (HMDs)), projection-based systems, heads-up displays (HUDs), vehicle windshields having integrated display capability, windows having integrated display capability, displays formed as lenses designed to be placed on a person's eyes (e.g., similar to contact lenses), headphones/earphones, speaker arrays, input systems (e.g., wearable or handheld controllers with or without haptic feedback), smartphones, tablets, and desktop/laptop computers. A head mounted system may have one or more speaker(s) and an integrated opaque display. Alternatively, a head mounted system may be configured to accept an external opaque display (e.g., a smartphone). The head mounted system may incorporate one or more imaging sensors to capture images or video of the physical environment, and/or one or more microphones to capture audio of the physical environment. Rather than an opaque display, a head mounted system may have a transparent or translucent display. The transparent or translucent display may have a medium through which light representative of images is directed to a person's eyes. The display may utilize digital light projection, OLEDs, LEDs, uLEDs, liquid crystal on silicon, laser scanning light source, or any combination of these technologies. The medium may be an optical waveguide, a hologram medium, an optical combiner, an optical reflector, or any combination thereof. In one embodiment, the transparent or translucent display may be configured to become opaque selectively. Projection-based systems may employ retinal projection technology that projects graphical images onto a person's retina. Projection systems also may be configured to project virtual objects into the physical environment, for example, as a hologram or on a physical surface.

The wave phenomenon of edge diffraction is experienced in many daily life situations. While being a very dominant phenomenon in outdoor areas, especially urban scenarios, it is also commonly experienced while in indoor environments. Imagine a sound source around a corner, such as a radio playing in a bedroom that that connects a hallway via an entry way (or door). While a person walks down the hallway towards the entry way of the bedroom, the sound field experienced by the person does not change abruptly but instead transitions smoothly. Specifically, the music playing on the radio may become louder and clearer the closer the person gets to the door. This transition comes from sound energy that is being perceived by the person diffracting or bending around the corner of the entry way and into the hallway.

Diffraction may also change how a person perceives sound. Sound source localization is a person's ability to identify a location or origin of a sound source based on spatial cues (e.g., Interaural time difference (ITD) and Interaural Level Difference (ILD), etc.). Sound diffraction may significantly affect a person's ability to locate a sound, due to how the diffraction changes the origin of the sound as perceived by the listener. For instance, sound that is diffracted by a corner of an entry way (or a wall) may be perceived as originating from an edge of the corner, rather than the actual origin (e.g., the nightstand on which the radio is positioned). In addition, when a sound wave hits an object or obstacle, a frequency-dependent shadow zone occurs behind the object. Continuing with the previous example, the object may be a cabinet that is positioned between the radio and the person who is in the room. When the radio plays music, the spectral content of the music will sound different to the person, than if the cabinet was not there. The music may sound different because the cabinet is acting as a baffle that may block or deflect at least some of the high-frequency content that cannot penetrate or bend around the cabinet.

In the context of CGR environments (or settings) simulation of spatial audio diffraction may be necessary to avoid discontinuities in three-dimensional (3D) sound field rendering. Such discontinuities would directly impact a user's feeling of immersion. Conventional diffraction modeling, however, is based on complex mathematical models (e.g., Biot-Tolstoy-Medwin (BTM) diffraction model or numerical solvers such as Boundary Element Method (BEM), Finite Element Method (FEM), Finite-Difference Time-Domain (FDTD) method, etc.) that include complicated numerical integration. Such models require a significant amount of computational power and cannot be feasibly used to simulate diffraction in a real-time audio rendering engine (e.g., while a user is participating in or interacting within a CGR setting via an electronic device, such as a HMD). Therefore, there is a need to accurately (e.g., within a tolerance threshold) simulate edge-diffraction in a CGR setting in real-time.

To accomplish this, the present disclosure describes a computer system that is capable of simulating edge-diffraction in a CGR setting. The system may include an electronic device that is communicatively coupled to at least one speaker (e.g., a speaker of a left earphone and a speaker of a right earphone) that is configured to output sound of the CGR setting. The system determines a listener (or listening) position (e.g., a position at which the wearer is aurally experiencing the CGR setting) within the CGR setting and determines a position of a virtual sound source within the CGR setting. For instance, continuing with the previous example, the system may determine a location of a virtual radio that is playing in a virtual house. The listening position may be a position of the wearer's avatar within the CGR setting. The system determines at least one characteristic of the virtual object within the CGR setting, where the characteristic may include a geometry of one or more edges (of one or more portions) of the virtual object and/or one or more positions of the one or more edges. The system determines several edge-diffraction filter parameters for an edge-diffraction filter based on 1) the listener position, 2) the source position, and/or 3) the geometry. For instance, the system may use these as inputs into a machine-learning (ML) algorithm that is configured to produce filter parameters as outputs. The system determines (or produces) an edge-diffraction filter according to the filter parameters and applies the edge-diffraction filter to an input audio signal to produce a filtered audio signal that accounts for the edge diffraction of sound produced by the virtual sound source within the CGR setting. Thus, the system is capable of accounting for edge-diffraction in real-time, without the need of any complex computation.

FIG. 1 shows an example of edge diffraction in a CGR setting. Specifically, this figure illustrates two stages 1 and 2 in which a virtual object 10 is positioned in between a virtual sound source (position) 3 and a listener (position) 4 in the CGR setting, thereby causing edge diffraction of the sound that is being produced by the source. Also illustrated is a user 5, an electronic device 6, a left earphone 7, and a right earphone 8 in a physical setting.

In this figure, the electronic device is a handheld that includes at least a display screen 9. In one aspect, the handheld may be any portable device, such as a smartphone, laptop computer, tablet computer, etc. The display screen is configured to display (or present) image and/or video data as a visual representation of the CGR setting to the user of the electronic device. In one aspect, the display screen displays a three-dimensional (3D) visual representation of the CGR setting, where the display screen displays slightly different images of the same setting (e.g., a stereoscopic 3D image). In one aspect, the display screen may be a miniature version of known displays, such as liquid crystal displays (LCDs), organic light-emitting diodes (OLEDs), etc. In another aspect, the display may be an optical display that is configured to project digital images upon a transparent (or semi-transparent) overlay, through which the user has at least a partial field of view of the physical setting. The electronic device may be arranged such that the display screen may be positioned in front of one or both of the user's eyes. For example, the electronic device may be arranged to be received by a head-worn device, such that when received the electronic device may display the 3D visual representation in front of the user's eyes. In one aspect, the electronic device 6 may be communicatively coupled (e.g., via a wireless communication data link using any wireless protocol) with the head-worn device (or any other electronic device) in order to obtain image (and/or audio) data for presentation.

In one aspect, any type electronic device that is capable of presenting image data and/or outputting audio data may be used to present the CGR setting (and/or perform real-time acoustic simulation of edge diffraction as described herein). For example, the electronic device 6 may be a HMD in which the display screen 9 is a part of the (e.g., permanently attached to) the electronic device, which is in contrast to the head-worn device described above which is arranged to receive (e.g., removeably couple to) the electronic device 6. As another example, the electronic device may be a stationary electronic device (e.g., a desktop computer, a television, etc.).

The left earphone 7 and the right earphone 8 are (e.g., a part of) over-the-ear headphones that are configured to be positioned over the user's ears. In one aspect, the earphones may be in-ear headphones (e.g., earbuds) or on-ear headphones. In another aspect, the earphones may be a pair of open back headphones that allow at least some of the ambient noise from the physical setting to mix with sound produced by speakers of the earphones. Each of the earphones includes at least one speaker that may be an electrodynamic driver that may be specifically designed for sound output at certain frequency bands, such as a woofer, tweeter, or midrange driver, for example. In one aspect, each speaker may be a "full-range" (or "full-band") electrodynamic driver that reproduces as much of an audible frequency range as possible. Each speaker "outputs" or "plays back" audio by converting an analog or digital speaker driver signal into sound. In one aspect, the earphones may be communicatively coupled with the electronic device 6. For example, the earphones may be configured to establish a wireless communication data link with the electronic device 6 using any wireless protocol (e.g., BLUETOOTH protocol) to receive audio data (audio signal) for use in driving one or more speakers. Thus, as described herein, to present sounds of the CGR setting, the electronic device may transmit audio data of the CGR setting to one or more of the earphones for output. In another aspect, the earphones 7 and/or 8 may be communicatively coupled to the electronic device 6 via one or more wires. In one aspect, the earphones 7 and 8 may be configured to establish the communication data link with a separate electronic device (e.g., a companion device with the electronic device) to receive the audio data.

In one aspect, the electronic device 6 may include one or more speakers integrated therein, and may be configured to present sounds of the CGR setting by outputting the sound through the speakers. In another aspect, the sounds may be presented through standalone speakers (e.g., a loudspeaker or a smart speaker). As another example, the electronic device may output sounds of the CGR setting through separate loudspeakers that are communicatively coupled (e.g., wired or wirelessly linked) to the electronic device.

In one aspect, the electronic device 6 may include more or less components (or elements) as described herein. For instance, the electronic device may include at least one microphone that may be any type of microphone (e.g., a differential pressure gradient micro-electromechanical system (MEMS) microphone) that is configured to convert acoustic energy caused by sound waves propagating in an acoustic environment into an audio signal. In one aspect, the electronic device may have a microphone array with two or more microphones that is configured to process audio (or microphone) signals of at least some of the microphones to form directional beam patterns for spatially selective sound pickup in certain directions, so as to be more sensitive to one or more sound source locations.

In one aspect, the earphones 7 and/or 8 may include more or less components as described herein. For example, the earphones may include "extra-aural" speakers that may be integrated into a housing of the earphones and arranged to project (or output) sound directly into the physical setting. This is in contrast to speakers of the earphones that are arranged to produce sound towards (or directly into) a respective ear of a user. In one aspect, these extra-aural speakers may form a speaker array that is configured to produce spatially selective sound output. For example, the array may produce directional beam patterns of sound that are directed towards locations within the environment, such as the ears of the user. As another example, the electronic device 6 may be wireless earphones (or headphones), which output sound of the CGR setting, thus not having a display screen. In one aspect, the electronic device 6 may be communicatively coupled to a separate display device (e.g., a smart TV) that is configured to display the CGR setting, while the electronic device 6 outputs sound of the CGR setting.

In one aspect, the electronic device 6 may include a CGR setting algorithm (application or software) that is stored in local memory of the electronic device, which when executed by one or more processors of the electronic device causes the device to perform at least some of the operations described herein (e.g., rendering operations and/or edge-diffraction simulation operations). For instance, the CGR setting algorithm may cause the electronic device to present the CGR setting (e.g., by rendering and displaying image data of the CGR setting on the display screen and outputting audio data (or audio signals) of the CGR setting through speakers of the earphones). As described herein, the electronic device may be a part of a computer system that includes a companion device (e.g., a smartphone, a laptop, etc.) with which the electronic device is communicatively coupled (via a wired or wireless connection). In one aspect, the companion device (e.g., at least one processor of the companion device) may perform at least some of the operations described herein. For example, the companion device may execute the CGR setting algorithm, and transmit data packets (e.g., Internet Protocol (IP) packets) to the electronic device that contain rendered image and/or audio data of the CGR setting for presentation by the electronic device.

In another aspect, the system may include at least one server with which the HMD (and/or companion) device communicates (via a network, such as the Internet). The server may be a real electronic server (e.g., having one or more processors), a virtual machine, or a machine running in a cloud infrastructure. In one aspect, the server (e.g., at least one processor of the server) may perform at least some of the operations described herein. In one aspect, the server is configured to perform cloud-based CGR setting rendering operations to render the CGR settings to be transmitted to the electronic device (and/or companion device), via the network for presentation.

In one aspect, the system may be configured to render the CGR setting in real-time based on user input. For example, the electronic device 6 may obtain user input (e.g., user-adjustments of a control that transmits control signals to the electronic device, etc.) that correspond to adjustments in listener or avatar position within the CGR setting. For example, the user 5 may have a handheld controller that allows the user cause the avatar to move forward. As another example, user input may include sensor data produced by one or more sensors of the system. For instance, movements of the avatar may be mimicked by movements of the user, using one or more onboard sensors (e.g., motion sensors) of the electronic device. In another aspect, the display screen 9 of the electronic device may be a touch-sensitive display screen that is configured to receive user input in response to touch (or taps) by the user (e.g., the user's index finger). In one aspect, sensors may be a part of separate electronic devices, such as cameras. In this example, movements of the user may be monitored through the using image data as the user input captured by cameras having a field of view that contains the user. The system may then use the user input to render the CGR setting.

In one aspect, the system may render audio data of CGR settings in real-time. For example, the electronic device 6 may obtain microphone signals captured by microphones of the electronic device, and transmit the microphone signals to the server. The server may render the CGR setting audio data and distribute the rendered audio data to electronic devices that are participating in the CGR setting, including electronic device 6 for output. In one aspect, the audio data may be spatially rendered according to the listener position in the CGR setting in order to provide an immersive audio experience to the user of the electronic device.

In another aspect, at least some of the rendering operations may be performed locally (e.g., by the CGR setting algorithm). For example, the server may distribute input streams and/or audio streams (e.g., including microphone signals) from other electronic devices of other users who are participating in the CGR setting.

Returning to FIG. 1, each stage includes a preview of a physical setting (or environment) that includes the user 5 (or wearer) who is using (or wearing) the electronic device 6 and a preview of the CGR setting that is being presented to the user through the (e.g., display screen 9 and/or earphones 7 and 8 of the) electronic device. Both settings are illustrated in top-down views. In one aspect, the listener 4 in the CGR setting is an avatar through which the user of the electronic device participates in the CGR setting. As illustrated, the listener position is the location in the CGR setting at which the user of the electronic device is to aurally experience the CGR setting through the earphones (left earphone 7 and/or right earphone 8). In one aspect, the listener position corresponds to the location at which the avatar is located within the CGR setting. In one aspect, the listener position may be located at a separate location than the avatar. In another aspect, the electronic device presents the CGR setting to the user through the perspective of the avatar (e.g., in a first-person perspective). Thus, in this case, a display screen 9 of the electronic device 6 may display the CGR setting, where the user 5 may see the virtual sound source 3 towards a left-hand side. In one aspect, the left earphone 7 and/or the right earphone 8, each have at least one speaker that is configured to output sound of the CGR setting (e.g., as heard from the perspective of the avatar, when experienced in the first-person perspective). In one aspect, rather than present (video and/or audio) the CGR setting in the first-person perspective, the electronic device may present the CGR setting in another perspective, such as a third-person perspective as illustrated herein.

Stage 1 illustrates a virtual sound source 3 (e.g., a radio) producing sound (e.g., music) within the CGR setting, from a front-left position with respect to the listener 4 of the user 5. This stage also illustrates that there is a straight direct sound path from the sound source to the listener. In one aspect, when the listener 4 is in a bounded area (e.g., a virtual room) the listener may also obtain early and/or late reflections of the sound produced by the virtual sound source. In one aspect, the electronic device 6 (and/or the earphones 7 and 8) may spatially render the sound (e.g., audio signal of the sound) to produce spatial audio in order to provide an immersive audio experience to the user of the electronic device. For example, the audio signal may be spatially rendered in order to produce spatially rendered audio signals (e.g., binaural signals) that provide spatial audio cues to give the user the perception that the sound is being emitted from a particular location within the CGR setting (e.g., from the front-left position). More about spatially rendering is described herein.

Stage 2 illustrates that a virtual object 10 has been placed in between the virtual sound source 3 and the listener 4. For instance, the virtual object may be a wall that separates the room in which the source is located and the hallway in which the listener 4 is located. Since the virtual object is between the sound source and the listener, the original direct path is being deflected by a side of the virtual object and back into the CGR setting (away from the listener position). Instead, sound that is reaching the listener is being diffracted by an edge of a corner of the wall. In one aspect, to account for this edge diffraction, the computer system (e.g., the electronic device 6) may perform edge-diffraction simulation operations upon the audio signal of the virtual sound source. The result being a filtered audio signal which when used to drive the speakers of the left earphone 7 and/or right earphone 8 produces edge-diffracted sound (e.g., sound that is being diffracted by and emanating from the edge of the virtual object). More about the edge-diffraction simulation operations is described herein.

Figure 2:
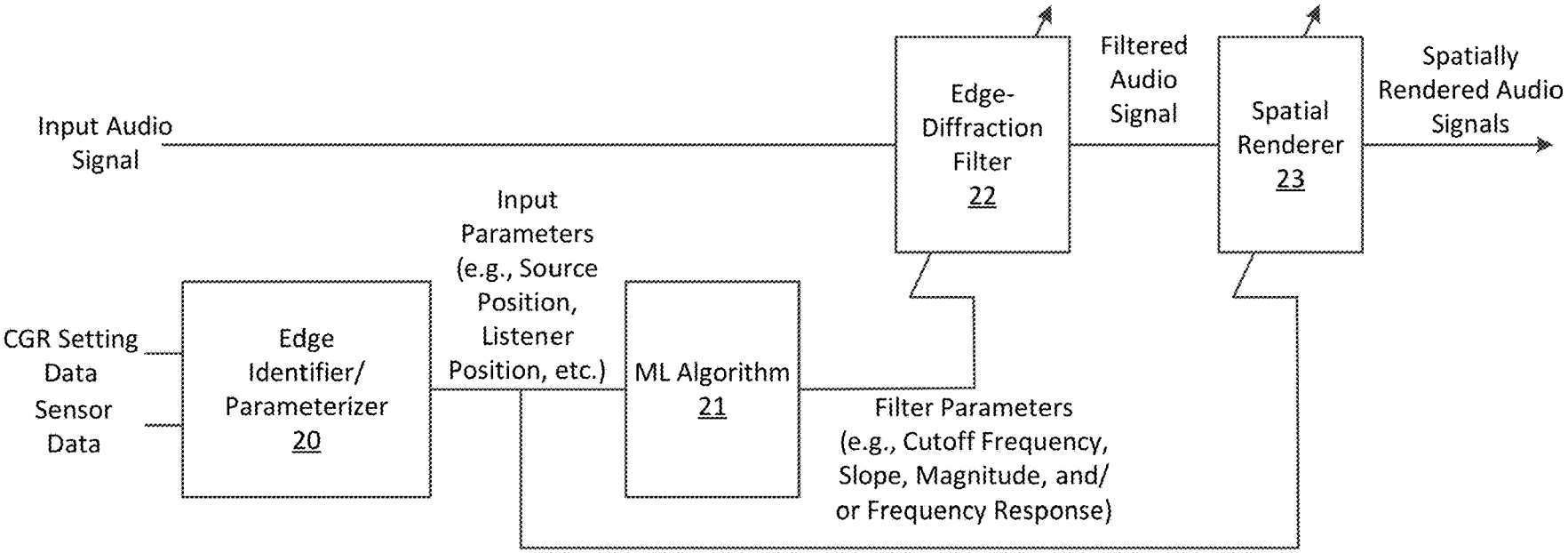
FIG. 2 shows a block diagram of a computer system for simulating edge-diffraction that is caused by an edge of an object according to one aspect of the disclosure.

FIG. 2 shows a block diagram of a computer system for simulating edge diffraction that is caused by an edge of an object according to one aspect of the disclosure. This figure includes hardware elements, such as an edge identifier/parameterizer 20, a machine-learning (ML) algorithm 21, an edge-diffraction filter 22, and a spatial renderer 23. In one example, these hardware elements are performed or implemented by one or more processors executing instructions for each of these blocks. For example, there may be edge identifier/parameterizer instructions, ML algorithm instructions, edge-diffraction filter instructions, and spatial renderer instructions. In one aspect, any of these instructions may be executed by processors of any component (or element) of the computer system described herein. For instance, the electronic device 6 may perform some instructions, while a companion device (and/or server) performs other instructions. As another example, one or more of the earphones 7 and 8 may perform at least some of the instructions (e.g., spatial rendering operations).

The process in which the computer system simulates edge-diffraction that is caused by an edge of a virtual object within a CGR setting will now be described. The edge identifier/parameterizer 20 is configured to obtain CGR setting data and/or sensor data and produce (or determine) input parameters, which may include the listener position, source positions of one or more virtual sound sources within the CGR setting, and at least some characteristics of at least one virtual object (and/or physical object) within the CGR setting (e.g., a geometry of an edge of the virtual object and position of the edge (or object) within the CGR setting). The parameterizer 20 may determine the positions based on the CGR setting data. For instance, the CGR setting data may include a data structure that includes positional data of objects within the CGR setting. Specifically, the data structure may include a table that associates virtual objects, such as the sound source (e.g., radio) 3, the virtual object 10, and the listener 4 with position data (e.g., with respect to a reference point within the CGR setting). In one aspect, the position data may be in any coordinate system (e.g., Cartesian, cylindrical, spherical, etc.). As an example, the listener position 4 and the source position 3 may both be cylindrical coordinates with respect to the edge of the virtual object. In another aspect, the CGR setting data may include (e.g., rendered) image data of the CGR setting. From the image data, the system may perform an object recognition algorithm to identify the virtual objects contained therein.

Figure 3:
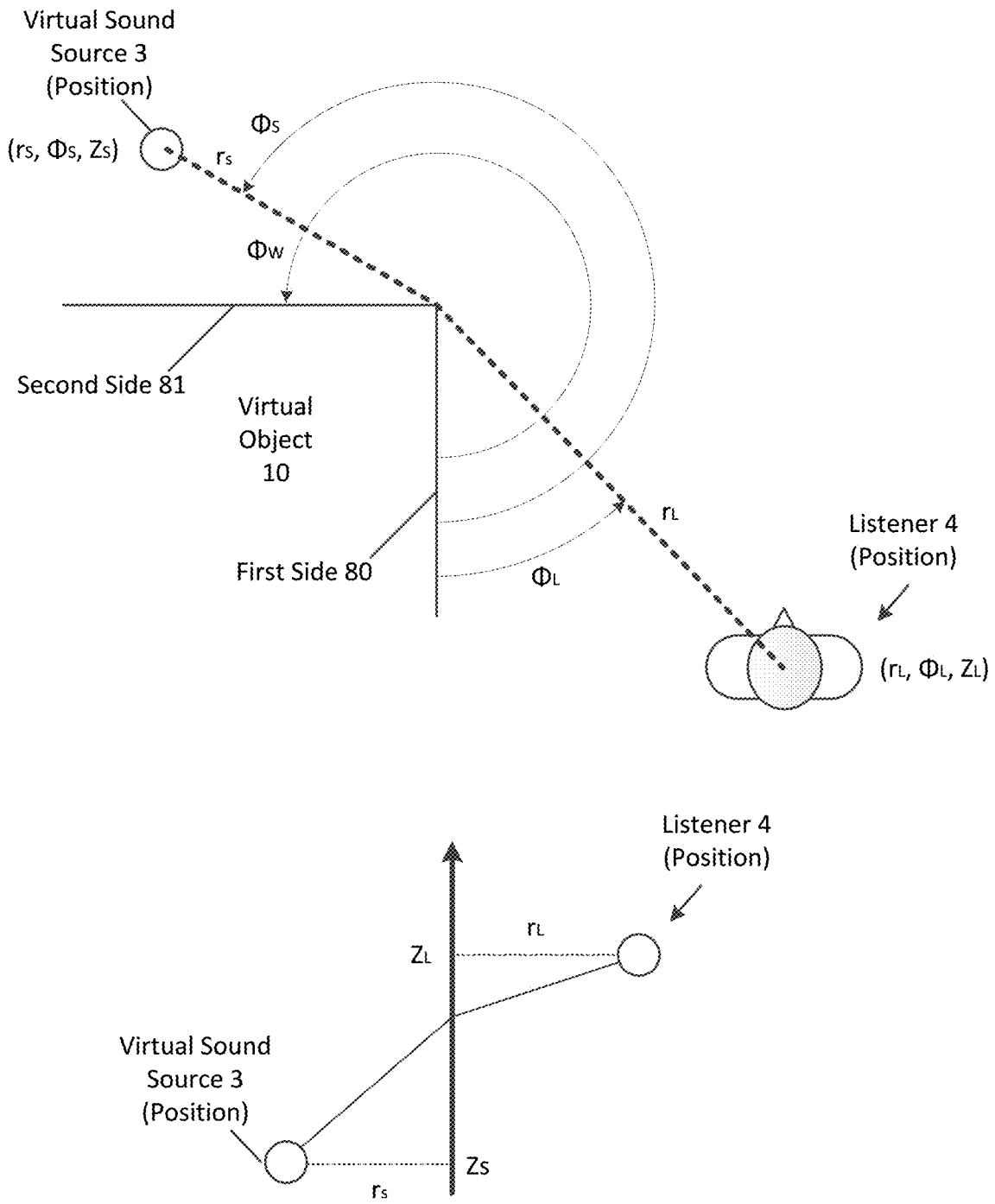
FIG. 3 shows positions of a virtual sound source and the listener as cylindrical coordinates with respect to the edge of the virtual object.

In one aspect, characteristics of the virtual object may include the object's dimensions, the object's position (e.g., with respect to a reference point in the CGR setting or with reference to the source and/or listener position), whether the object has an edge, and a geometry of the edge of the virtual object. In one aspect, the geometry is of a portion of the virtual object that includes an edge, such as a corner or wedge. The parameterizer may determine whether the virtual object within the CGR setting has an edge based on a performance of the object recognition algorithm, as previously described. In one aspect, edges may be associated with boundaries of the CGR setting, such as a corner of a virtual wall. In one aspect, the geometry may include a first side (e.g., side 80 as illustrated in FIG. 3) of the virtual object and a second side (e.g., side 81 as illustrated in FIG. 3) of the virtual object, where both sides intersect at an edge (e.g., to make a corner of the virtual object). In another aspect, the geometry may include an angle from the first side 80 of the virtual object 10 to a second side 81 of the virtual object that is about an axis (e.g., z-axis) that runs through a longitudinal path of the edge, such as $\Phi_w$ that is illustrated in FIG. 3.

In one aspect, the edge by which edge-diffraction simulation operations as described herein are performed may be an edge on the inside of a corner of a virtual object. As illustrated in FIG. 2, the edge is located on the outside of the corner of the virtual object. This may not always be the case. Instead, the edge may be associated with an inside corner, such as a corner of a room.

As described herein, the positions of the source, virtual object, and/or the listener may be in any coordinate system with respect to a reference point within the CGR setting. For instance, the reference point may be the edge of the virtual object. FIG. 3 shows positions of the sound source and the listener as cylindrical coordinates with respect to the edge of the virtual object 10 of FIG. 1. For instance, the listener position is ($r_L$, $\Phi_L$, $Z_L$), where $r_L$ is the distance between the edge and the listener, $\Phi_L$ is the angle between the first side 80 of the object to the listener about the z-axis that runs through the edge, and $Z_L$ is the height of the listener position along the z-axis. In one aspect, the listener position corresponds to the listener's head (e.g., the avatar's head). Similarly, the position of the virtual sound source is ($r_S$, $\Phi_S$, $Z_S$), where $r_S$ is the distance between the edge and the source, $\Phi_S$ is the angle between the first side 80 of the object to the source position about the z-axis. In another aspect, at least one of the positions (source and/or listener) may be with respect to a different reference point within the CGR setting. In some aspects, the orientation of the cylindrical coordinates may be different.

In another aspect, the edge identifier/parameterizer 20 may determine at least one characteristic of physical objects within the physical setting. For example, in the case in which the CGR setting is a mixed reality (MR) setting, the edge identifier/parameterizer 20 may simulate edge diffraction based on a (e.g., virtual) sound that is to be diffracted by an edge of a physical object (e.g., an edge of a real wall within the physical setting). More about physical objects are described herein.

Returning to FIG. 2, as described herein, sensor data may be produced by one or more sensors of the system, and may be used to control actions or movements to be performed by the listener (or the user's avatar) within the CGR setting. For instance, sensor data produced by an accelerometer (or gyroscope) that is integrated into the electronic device that indicates movement (e.g., of the user's body and/or head), which may be used to adjust the listener's body and/or head within the CGR setting, thereby changing the listener's field of view within the CGR setting. As another example, sensor data may be produced by sensors that are in other electronic devices that are communicatively coupled to the electronic device (e.g., a companion device, or a standalone sensor device). For example, when the companion device is a smartphone that is being held by the user, accelerometers (and/or gyroscopes) integrated within the smartphone may provide an indication of the user's movements. In one aspect, sensor data from any type of sensor may be used (e.g., a magnetometer, etc.). In another aspect, the parameterizer 20 may use sensor data (e.g., produced by the accelerometer) to determine orientation data of the listener (e.g., with respect to the virtual sound source) within the CGR setting, as an input parameter. In another aspect, the sensor data may be produced by one or more cameras (e.g., that are integrated within the electronic device). Specifically, the sensor data may be image data produced by the cameras. For example, the parameterizer may use the image data to determine a user's movements based on changes within captured image data. In another aspect, the image data may also be used to determine physical characteristics of physical objects (e.g., using the object recognition algorithm described herein) for which edge diffraction may being simulated. More about simulating edge diffraction with physical objects is described herein.

The ML algorithm 21 is configured to obtain the input parameters that are determined by the parameterizer 20, and use the input parameters to determine (compute or output) one or more edge-diffraction filter parameters for the edge-diffraction filter 22. For instance, the ML algorithm may determine the filter parameters based on at least 1) the listener position, 2) the source position, and a geometry (e.g., an angle from one side to another side) of the virtual object. In one aspect, both positions may be cylindrical coordinates with respect to the edge of the virtual object. In one aspect, the ML algorithm may be any learning algorithm that takes input parameters as input and determines one or more filter parameters as output. In one aspect, the ML algorithm may be an algorithm built using supervised machine learning. Examples of supervised learning algorithms may include a support vector machine (SVM), neural networks, etc. In the case in which the ML algorithm is a neural network, the ML algorithm processes the input parameters through one or more hidden layers to generate one or more filter parameters. In another aspect, the ML algorithm may be an algorithm built using unsurprised learning, such as a Gaussian mixture model, hidden Markov model, etc. In one aspect, in addition to (or in lieu of) a ML algorithm, the system may computer the filter parameters by performing a table lookup into a data structure that associates input parameters with one or more filter parameters. In one aspect, the data structure may be remotely obtained (e.g., from a server over the Internet) and stored locally.

In one aspect, the filter parameters may be any parameters that are used to define (or determine) an audio signal processing filter. For example, the filter parameters may include a passband magnitude or gain (e.g., in dB), a cutoff frequency, and a roll-off slope. In one aspect, the ML algorithm 21 is configured to output filter coefficients rather than (or in addition to) the filter parameters. In this case, the edge-diffraction filter 22 may use the filter coefficients to generate a filter to be applied to the input audio signal. In another aspect, the ML algorithm may output (e.g., as one of the filter parameters) a frequency response of the edge-diffraction filter that filter 22 is to apply to an input audio signal as described herein. Thus, in this aspect the frequency response may be in the frequency domain. In another aspect, the ML algorithm may output the edge-diffraction filter that is to be used to filter the input audio signal.

The edge-filter 22 is configured to obtain one or more filter parameters that are determined by the ML algorithm and use the filter parameters to determine (or derive) an edge-diffraction filter. In one aspect, the filter 22 may perform one or more computations to determine the edge-diffraction filter based on at least one of the filter parameters. In one aspect, the edge-diffraction filter may be any type of filter, such as a low-pass filter, a high-pass filter, an all-pass filter, and/or a band-pass filter.

The edge-diffraction filter 22 is configured to obtain an input audio signal that contains sound of the virtual sound source that is to be (or is being) diffracted by the edge (or wedge) of the virtual object. The filter 22 applies the edge-diffraction filter that was determined from the one or more filter parameters to the input audio signal to produce a filtered audio signal that accounts for edge diffraction within the CGR setting.

The spatial renderer 23 is configured to obtain one or more of the input parameters and determine one or more spatial audio filters (or spatial transfer function), such as head-related transfer functions (HRTFs). Specifically, the spatial renderer 23 may determine (or select) the spatial filters according to the source position within the CGR setting with respect to the listener position in order to provide spatial audio cues to give the user of the electronic device 6 the perception that the virtual sound source is emitting sound in front of and to the left of the user (e.g., when the orientation of the user corresponds to the orientation of the listener in the CGR setting). In one aspect, the spatial filters (that are stored within the data structure) may be personalized for the user of the electronic device in order to account for the user's anthropometrics.

In another aspect, the spatial renderer 23 may spatially render audio of the CGR setting (e.g., including the (e.g., filtered) audio signal) through any method. In one aspect, the spatial renderer 23 may spatially reproduce the audio either through headphone reproduction (e.g., binaural) or loudspeaker-based reproduction (e.g., Vector-Based Amplitude Panning (VBAP), Higher Order Ambisonics (HOA), etc.). For instance, the render 23 may produce a set of spatially rendered audio signals according to either reproduction for driving one or more speakers (e.g., such as loudspeakers for the loudspeaker-based reproduction). As another example, the spatial renderer 23 may spectrally shape the input audio signal differently for each of several speakers to spatially render the audio signal. In one aspect, the spatial renderer 23 may determine how to amplitude pan based on the location of the edge with respect to the listener position. As another example, the virtual sound field of the CGR setting may be represented in an angular/parametric representation, such as an HOA representation (e.g., into HOA B-Format). As a result, the spatial renderer 23 may render the audio signal by decoding the HOA representation in order to cause the audio signal to be emitted from the edge, as described herein.

In another aspect, the spatial renderer 23 may select spatial filters based on the position (or location) of the edge of the virtual object that is diffracting the sound of the virtual sound source. Specifically, since the listener 4 is obtaining diffracted sound from the edge of the virtual object, the edge may be considered the (new) virtual sound source (or secondary virtual sound source with respect to the original virtual sound source) instead of the virtual sound source 3. In other words, although the sound is being produced at the virtual sound source, the edge-diffraction causes the user to perceive the sound as if it is being produced by the (e.g., apex point of the) edge (e.g., as if a speaker was placed at the location of the edge). Thus, the spatial renderer 23 may determine the spatial filter according to a path from the listener position to the edge of the virtual object. As a result, when the spatially rendered audio signal is used to drive at least one speaker, the sound will be perceived by the user of the electronic device 6 to emanate from the edge of the virtual object, rather than from the sound source.

The spatial renderer 23 is configured to obtain the filtered audio signal and spatially render the filtered audio signal according to the determined spatial filters to produce one or more spatially rendered audio signals. In one aspect, the spatial renderer 23 may produce one spatially rendered audio signal for output through (one or both of the) speakers of the earphones 7 and 8. For example, the renderer 23 may apply HRTFs to perform binaural rendering to produce binaural signals for output through one or more speakers of the earphones (e.g., a left audio signal for a speaker of the left earphone 7 and a right audio signal for a speaker of the right earphone 8). These binaural signals cause the speakers to produce three-dimensional (3D) sound with spatial audio localization cues that give the user the perception that the sound are being emitted from a particular location within an acoustic space. This 3D sound provides acoustic depth that is perceived by the user at a distance that corresponds to a virtual distance between the virtual sound source (or edge of the virtual object) and the user's avatar.

In one aspect, the spatial renderer 23 may spatially render different audio signals. In some aspects, the renderer 23 may spatially render the audio signal differently based on whether the listener position is in the far-field or the near-field with respect to the edge. For instance, if the listener position is within a threshold distance (e.g., one meter) of the edge, the renderer may apply near-field compensation filters to the audio signal. If, however, the listener position exceeds the threshold distance, the renderer 23 may not apply such filters.

In one aspect, the spatial renderer may perform additional audio signal processing operations (e.g., according to the input parameters) upon the filtered audio signal, such as reverberation and equalization. In another aspect, the spatial renderer 23 may perform other audio signal processing operations upon the audio signal (e.g., applying a gain, etc.).

As described herein, one or more of the edge-diffraction simulation operations may be performed in real-time. For instance, the computer system may adjust (or adapt) the edge-diffraction filter and/or the spatial filters based on changes in the CGR setting. As an example, when the electronic device 6 obtains user input from the user 5 (e.g., via a control device that is communicatively coupled to the electronic device 6) to make the listener 4 move (or step) backwards in the CGR setting of FIG. 1, the computer system may determine new input parameters, and from the new input parameters compute new filter parameters using the ML algorithm 23. In one aspect, at least some of the filter parameters determined by the ML algorithm 23 are dependent upon at least some of the input parameters. With new filter parameters, the edge-diffraction filter 22 adapts the edge-diffraction filter. Similarly, the spatial renderer 23 will adapt spatial filters based on any changes to the input parameters.

In one aspect, the computer system may perform variations of the edge-diffraction operations described herein. For instance, the computer system may perform at least some operations, while omitting others. As an example, the operations performed to spatially render the filtered audio signal may be omitted, resulting in using the filtered audio signal to drive speakers of the left earphone 7 and/or the right earphone 8.

As described thus far, the process of FIG. 2 simulates the edge-diffraction that is caused by an edge of a virtual object within a CGR setting. In one aspect, the CGR setting may be a VR environment in which the listener, the sound source, and the object are simulated by the electronic device, such as shown in FIG. 1. In another aspect, rather than (or in addition to) simulating edge-diffraction for virtual objects, the computer system may simulate edge-diffraction caused by physical objects in the CGR setting, such as a MR environment in which virtual objects may be incorporated into a presentation of the physical setting via the display screen 9. As an example, the computer system may simulate edge-diffraction caused by a physical objects interaction with virtual sound sources, such as if the virtual object 10 in FIG. 1 were to be a real wall. As a result, the operations described herein may be performed with respect to a physical object. For example, the edge identifier/parameterizer 20 may be configured to obtain CGR setting data and/or sensor data to produce input parameters, which may include a listener position (e.g., which may correspond to a virtual position of the user, such as listener position 4 or a physical position of the user 5 in the physical setting), one or more source positions, and at least some (e.g., physical) characteristics of at least one physical object within the MR environment (or more specifically within the physical setting). For example, the characteristics (e.g., a geometry) may be determined based on image data captured by one or more cameras of the system (e.g., using the object recognition algorithm described herein). The ML algorithm 21 may be configured to obtain the input parameters, such as the listener position (e.g., the physical position of the user), the source position, and a geometry of the physical object, and compute one or more edge-diffraction filter parameters, as described herein.

Figure 4:
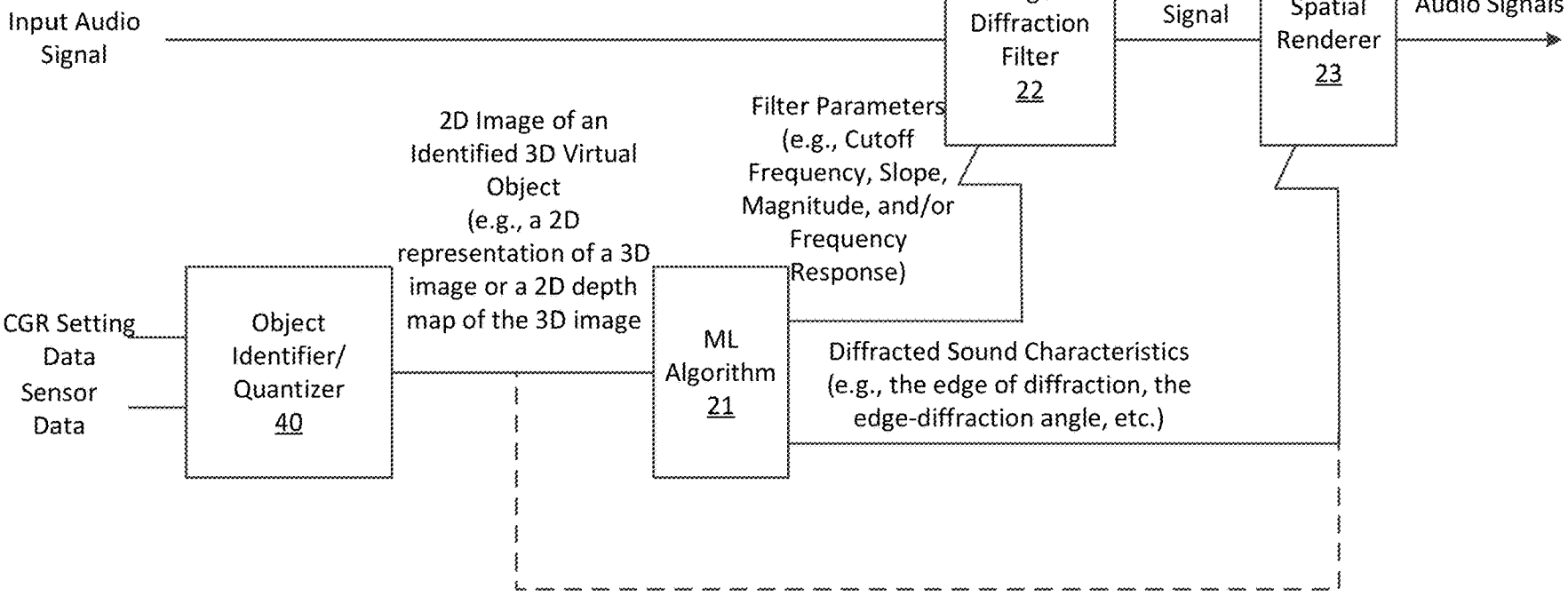
FIG. 4 shows a block diagram of a computer system for simulating edge-diffraction according to another aspect of the disclosure.

FIG. 4 shows a block diagram of a computer system for simulating edge-diffraction by a 3D virtual object according to one aspect of the disclosure. This figure includes similar hardware elements than those described in FIG. 2, such as the ML algorithm 21, the filter 22, and the spatial renderer 23. In contrast to FIG. 2, however, this figure includes an object identifier/quantizer 40 instead of the parameterizer 20. In one aspect, these hardware elements are performed or implemented by one or more processors executing instructions for each of these blocks, as described herein.

The process in which the computer system simulates edge diffraction according to another aspect of the disclosure will now be described. The object identifier/quantizer 40 is configured to obtain CGR setting data and/or sensor data, and is configured to identify a virtual object within the CGR setting. In one aspect, the object identifier/quantizer 40 may perform similar operations as the parameterizer 20 to identify an object. For instance, when the CGR setting data includes 3D image (and/or video) data of the CGR setting, the quantizer may perform the object recognition algorithm to identify the virtual object contained therein. In another aspect, the CGR setting data may include a data structure that indicates whether there are any objects within the CGR setting. In one aspect, the quantizer 40 may determine, from the CGR setting data, a source position of a virtual sound source within the 3D CGR setting and/or determine a listener position (e.g., of an avatar) within the 3D CGR setting that is to be aurally experienced by a user of the electronic device through at least one speaker (which may be integrated into the electronic device, or integrated in another device). In another aspect, the quantizer may determine the positions and/or orientations of objects based on the CGR setting data, as described herein.

In one aspect, the identifier/quantizer 40 is configured to determine whether at least a portion of the identified 3D virtual object is positioned between a sound source position and a listener position. Specifically, the quantizer is determining whether the 3D virtual object is (e.g., at least partially) occluding (or blocking) a direct sound path between the sound source position and the listener position. To do this, the quantizer determines 1) the source position of the virtual sound source within the 3D CGR setting, 2) the listener position within the 3D CGR setting that is to be aurally experienced by the user of the electronic device through the left earphone 7 and the right earphone 8, and/or 3) a position (and/or orientation) of the virtual object. The identifier may then project a line (e.g., a direct line of sight) from the sound source position to the listener position, and if at least a portion of the 3D virtual object blocks the path of the line, it may be determined that the portion of the object is in between both positions.

The identifier/quantizer 40 is configured to produce a two-dimensional (2D) image that contains a projection of the 3D virtual object on a 2D plane. Specifically, the quantizer produces a 2D representation of the 3D virtual object on the 2D plane. To do this, the quantizer may define the 2D plane as a plane that runs through (or in front of or behind) the listener position, where a projected line (or the direct path) from the source position to the listener position is perpendicular to the 2D plane. In one aspect, the 2D plane may be positioned at any location and/or the direct path does not necessarily need to be perpendicular to the 2D plane. The quantizer may project (e.g., a silhouette of) the object on top of the 2D plane. For instance, the identifier 40 may produce the 2D image by removing (or cropping) the dimension of the 3D virtual object that is not accounted for by the 2D plane (e.g., the z-axis). In one aspect, the 2D image may also include a visual indication (e.g., a dot) of the listener (position) that is overlaid on the 2D image. In one aspect, the identifier 40 may use any method to produce the 2D image. In another aspect, the 2D image may be in any type of image format (e.g., JPEG, bitmap, etc.).

In one aspect, the dimensions of the 2D projection may be adjusted based on a distance between the object and the listener position. For instance, the further away the virtual object is from the listener position in the z-direction, the more the quantizer will reduce the x and y dimensions of the projection. Thus, the quantizer may reduce the dimensions in proportion to the distance between the virtual object and the listener position in the z-direction. In one aspect, regardless of where the 2D plane is positioned, the dimensions of the 2D projection correspond to the current dimensions of the 3D virtual object.

The identifier/quantizer 40 is configured to produce the 2D image as a 2D quantized depth map, where discrete samples (e.g., pixels) of the 2D image include data (e.g., pixel values) that indicates a thickness of a corresponding portion of the 3D virtual object. The quantizer may sample the 2D image to produce a discrete space of the 2D image as a plurality of discrete pixels (or samples). For instance, the quantizer may sample the image as an M×N matrix of pixels (where M is a number of columns and N is a number of rows). For each sample, the quantizer 40 may quantize a thickness of a corresponding portion of the 3D virtual object in the z-axis that is perpendicular to the 2D plane to a value within a range of values, where each value represents a thickness. For instance, the quantizer may quantize the 2D image in grayscale, where the range of values may be pixel values between 0 and 255. In one aspect, the range may be lower, such as between 0 to 16 in order to reduce the file size of the depth map. The higher the pixel value, the thicker the corresponding portion of the virtual object, and the lower the pixel value, the thinner the corresponding portion of the virtual object. In another aspect, the quantizer 40 may use any color scheme to represent the depth of the object. In one aspect, the quantizer 40 may quantize the 2D image with two pixel values (e.g., black indicating a portion of the 2D projection in the 2D image, while white indicates a portion of the 2D image that does not include the 2D projection). In one aspect, the quantizer 40 may produce the 2D image as a depth map of the projection of the 3D virtual object, without sampling and/or quantizing the image. For instance, the quantizer may define several layers (e.g., as colors, such as grayscale), where each layer represents a corresponding thickness of the 3D virtual object in the z-direction that projects out of and perpendicular to the 2D plane.

The ML algorithm 21 is configured to obtain the 2D image of the identified 3D virtual object. Specifically, the algorithm may obtain a 2D representation of the 3D image and/or a 2D quantized depth map, as described herein. The ML algorithm is configured to use the 2D image to determine (compute or output) one or more edge diffraction filter parameters for the edge-diffraction filter 22. In one aspect, the ML algorithm may produce the same or similar filter parameters as described in FIG. 2. In another aspect, the ML algorithm may determine other filter parameters.

Figure 5:
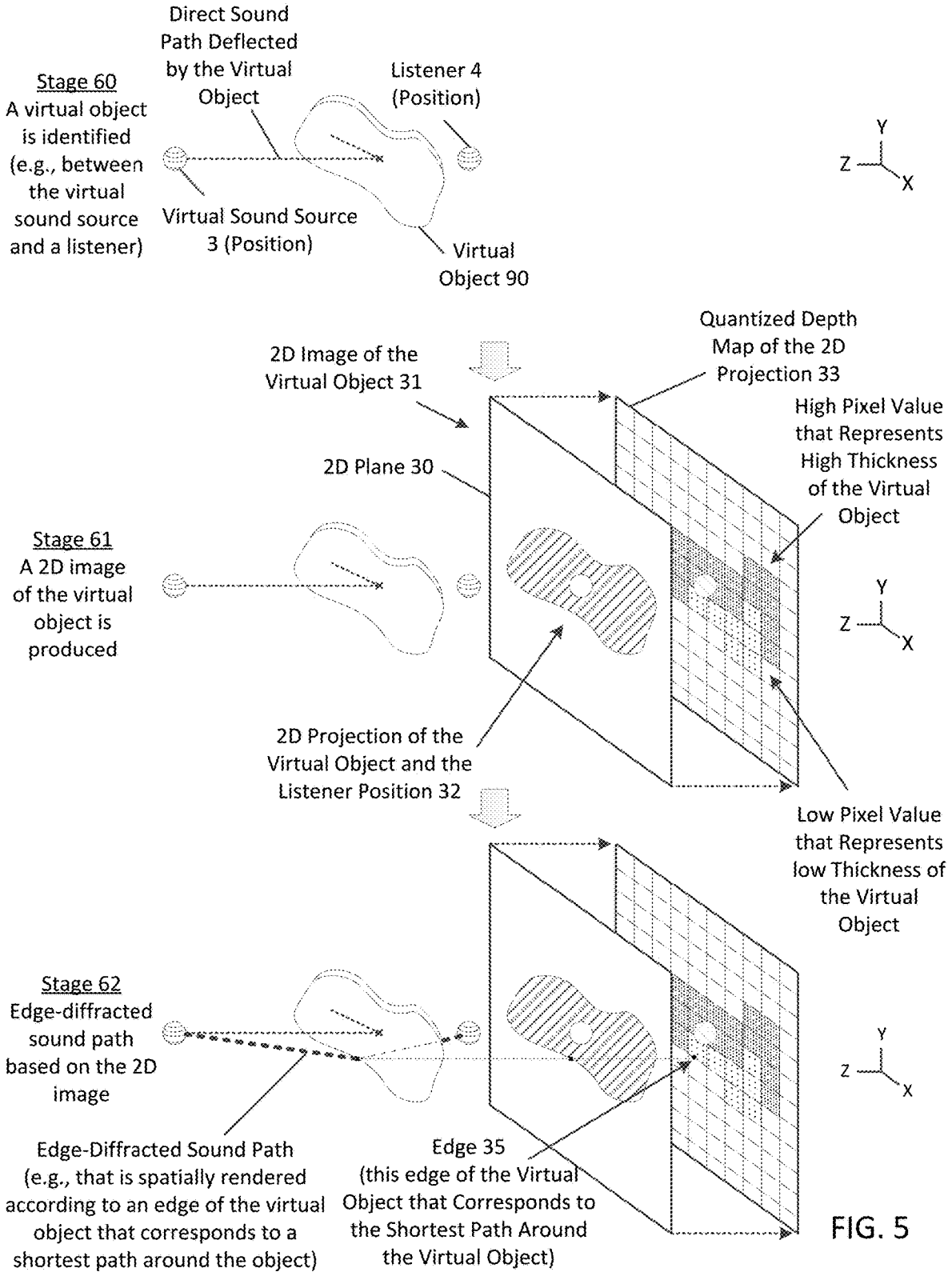
FIG. 5 shows an example of a three-dimensional (3D) CGR setting in which sound is diffracted by a 3D virtual object that is at least partially occluding the virtual sound source from the listener.

In one aspect, the ML algorithm may determine characteristics of the diffracted sound that may be used by the spatial renderer for spatially rendering the filtered audio signal. Specifically, the ML algorithm may determine data that the spatial renderer uses to spatially render the filtered audio signal (e.g., data used to select at least one spatial filter, as described herein). For instance, from the quantized depth map the ML algorithm may determine a shortest (sound) path from a source position to a listener position and around the 3D virtual object according to the 2D image (e.g., depth map). For instance, a shortest path may represent a path that sound travels (from the sound source) with the least amount of deviation from the original direct sound path, while not traveling through the 3D virtual object. In one aspect, the shortest path is a path that is diffracted by an (or at least one) edge of the 3D virtual object and directly to the listener position. In one aspect, the shortest path is a path that has a minimal deviation (or less than a threshold deviation) from a direct path from the source position to the listener position, without traversing through the 3D virtual object. In one aspect, the ML algorithm may determine this path based on pixel values of the depth map (which correspond to thickness of the 3D virtual object) and/or the distance between the listener position (and/or source position) depicted on the 2D image 31 (e.g., the location at which the z-axis projects through the 2D projection 32 and to the source position 3, as illustrated in FIG. 5) and perimeter of the 2D projection (or quantized 2D image). For instance, the ML algorithm may select an edge that is closest to the listener position depicted on the 2D image and/or may select an edge that is associated with a pixel with a lower (or lowest) quantized value. In one aspect, the ML algorithm may determine an edge-diffraction angle (e.g., Euler angles, etc.) at which the sound path from the virtual sound source diffracts at the (at least one) edge of the 3D virtual object and traverses to the listener position. In this case, the edge may represent a reference point at which the angle is determined. The ML algorithm may transmit these characteristics to the spatial renderer 23. In one aspect, any of characteristics of the diffracted sound may be determined by the ML algorithm, in response to the input of the 2D image.

The edge-diffraction filter 22 is configured to obtain the filter parameters, use the filter parameters to determine an edge-diffraction filter, and apply the filter to the input audio signal to produce a filtered audio signal, as described herein.

The spatial renderer 23 is configured to obtain the diffracted sound characteristics and use the characteristics to determine one or more spatial audio filters (or spatial transfer functions). For example, the spatial renderer may use the shortest path determined by the ML algorithm 21 to determine at least one spatial filter. As a result, when the filtered input audio signal is spatially rendered an edge of the 3D virtual object that is along the shortest path may act as the secondary virtual sound source, as described herein. As another example, the spatial renderer may use the edge-diffraction angle to determine the location (or direction) at which the filtered audio signal is to be spatially rendered. In one aspect, the spatial renderer may determine a distance at which the signal is to be rendered in the direction based on the characteristics of the virtual object and/or based on the CGR setting data. For instance, the spatial renderer may determine the distance based on the position of the virtual object and the position of the listener. Thus, from the direction and/or distance, the spatial renderer is configured to select one or more spatial audio filters (e.g., based on a table lookup into a data structure, as described herein). The spatial renderer is configured to obtain the filtered audio signal and spatially render the signal according to the one or more determined spatial audio filters to produce one or more spatially rendered audio signals. As described herein, the spatial rendering of the filtered audio signals using the spatial filters will give the user the perception that the sound of the virtual sound source is (at least partially) emanating from (or near) the virtual object (e.g., from an edge of the virtual object that is associated with the edge-diffraction angle).

In one aspect, the spatial renderer 23 is configured to obtain the 2D image (from the quantizer 40) and determine the one or more spatial audio filters (or spatial transfer functions) in lieu of (or in addition to) the ML algorithm 21. Specifically, the renderer 23 may use the 2D depth map produced by the quantizer 40 to determine the edge-diffraction angle, as described herein with respect to the ML algorithm 21. For instance, the spatial renderer may determine the shortest path (rather than the ML algorithm), and from the shortest path determine an edge at which the sound is reproduced. In one aspect, since the 3D virtual object may contain many edges, the renderer may spatially render input audio signal according to at least some of the edges and then mix the spatially rendered audio signals to produce a mix for use in driving the speakers of the earphones 7 and 8.

In one aspect, the computer system may perform one or more of the edge-diffraction simulation operations described in this figure in real-time. For instance, the computer system may adjust (or adapt) the edge-diffraction filter and/or spatial filters based on changes in the CGR setting (e.g., based on sensor data obtained by the object identifier/quantizer 40). For instance, the sensor data may include user input that moves the listener position to a new location. Once (or while) the listener position is moving, the object identifier/quantizer 40 may produce new 2D images of the identified 3D virtual object, which may be used by the computer system to adjust the filters, as described herein.

FIG. 5 shows an example of a 3D CGR setting in which sound is being diffracted by the 3D virtual object that is at least partially occluding the virtual sound source from the listener. Specifically, this figure illustrates three stages 60, 61, and 62 in which sound (e.g., a direct sound path) being emitted by the virtual sound source 3 is being deflected off of the virtual object 90, thereby preventing the direct sound path from reaching the listener 4. In response, the computer system performs edge-diffraction simulation operations as described in FIG. 4 to determine the edge-diffracted sound path around the virtual object for output through the electronic device (or more specifically the earphones 7 and 8). Thus, this figure will be described with reference to FIG. 4.

Stage 60 shows the virtual sound source 3, a virtual object 90, and a listener 4. As an example, the sound source 3 may be a virtual radio that is playing music on a nightstand in a virtual room. The virtual object 90 may be a virtual cabinet that is between the virtual radio and the listener 4 (e.g., an avatar of the user of the electronic device that is participating in the CGR setting). As a result, a direct sound path from the source to the listener is being deflected by the virtual object. In one aspect, the computer system (e.g., the object identifier/quantizer 40) may identify that the virtual object 90 is between the source and the listener, as described herein.

Stage 61 shows that a 2D image of the virtual object 31 is produced. As shown, from the 3D virtual object 90, the quantizer 40 produces a 2D image of the virtual object 31 that includes a 2D projection of the virtual object (and the listener) 32 on a 2D plane 30. As illustrated, the 2D projection 32 represents the 3D virtual object from a perspective of a reference point along a z-axis (e.g., perpendicular to the 2D plane 30) and behind the listener. In one aspect, the 2D projection 32 may represent the 3D virtual object from any perspective. This stage also shows a quantized depth map of the 2D projection 33. The depth map 33 is a M×N matrix of samples (e.g., pixels), where higher pixel values (indicated by darkly colored samples) represent a high thickness (e.g., 1 inch) of the 3D virtual object along the z-axis, while lower pixel values (indicated by lightly colored samples) represent low thickness (e.g., 0.1 inches) of the 3D virtual object along the z-axis. As described herein, the ML algorithm 21 may obtain the 2D image 31 and determine the filter parameters, which are used by the filter 22 to determine edge-diffraction filter. The filter 22 applies the determined edge-diffraction filter to the input audio signal to produce the filtered audio signal.

Stage 62 shows the edge-diffracted sound path that is spatially rendered based on the 2D image. Specifically, the renderer 23 uses the quantized depth map 33 to determine an edge 35 of the virtual object 90 that is associated with a shortest path around the virtual object 90. The renderer spatially renders the filtered audio signal according to the edge 35 in order to produce spatially rendered audio signals, which when used to drive the speakers of the earphones, produces the edge-diffracted sound path.

In one aspect, the operations described in FIGS. 4 and 5 may be performed for simulating edge-diffraction by a physical object. For instance, the CGR setting may be a MR environment, which may include a virtual sound source and one or more physical objects that at least partially occludes a direct sound path between the sound source and the listener position, which may correspond to a virtual position of the user or a physical position of the user (e.g., in the physical setting). In this case, the operations described herein may be performed with respect to the physical object. For example, the object identifier/quantizer 40 may be configured to identify the physical object within the MR environment, as described herein. The quantizer may also determine whether at least a portion of the physical object is positioned between a sound source position and the listener position, as described herein, and in response produce a 2D image that contains a projection of the physical object on a 2D plane. The ML algorithm 21 may obtain the 2D image and determine characteristics, as described herein.

In one aspect, the computer system may determine whether to perform edge-diffraction simulation operations of FIG. 2 or of FIG. 4, based on certain criteria. For instance, the computer system may perform the edge-diffraction operations of FIG. 4 upon determining that at least a portion of an object is occluding a direct sound path from the source position to the listener position, as described herein. In another aspect, the computer system may determine whether the (e.g., virtual) object is a complex virtual object, such that the object includes a number of edges, around which sound produced by the sound source may be diffracted, is above a threshold. For instance, the virtual object 10 illustrated in FIG. 1 may have a number of edges below the threshold, resulting in the computer system performing the simulation operations of FIG. 2. In contrast, the system may perform the simulation operations of FIG. 4 upon determining that the virtual object 90 is a more complex virtual object than virtual object 10, having a number of edges above the threshold. In another aspect, the CGR setting data may indicate which operations to perform. In another aspect, the determination may be based on the type of object that is edge-diffracting the virtual sound. In this case, the system may determine an object that is in between the source and listener position, and perform a table lookup into a data structure that associates objects with the type of simulation operations to be performed.

In some aspects, the determination of whether to perform edge-diffraction simulation operations of FIG. 2 and/or of FIG. 4 may be based on the electronic device of the computer system that is to perform at least some of the operations. Specifically, the operations performed in FIG. 2 may require more processing power (e.g., more computations to be performed by one or more processors) than the operations of FIG. 4. As a result, if the electronic device is a portable device, such as a smart phone or HMD, which has low power requirements (e.g., with available processing power below a threshold), the device may perform the edge-diffraction simulation operations of FIG. 4. Otherwise, the electronic device may perform the edge-diffraction simulation operations of FIG. 2.

In another aspect, the determination of whether to perform the operations of FIG. 2 or FIG. 4 may be based on a tolerance threshold. For instance, the filter parameters determined by the ML algorithm in FIG. 2 may be more precise and accurate than the parameters determined in FIG. 4 (e.g., by a threshold or tolerance). Thus, if the computer system determines that the filter parameters are to be determined within a tolerance value (e.g., within 5% accuracy), the system may determine the filter parameters based on the input parameters of FIG. 2.

In one aspect, the computer system may perform at least some of the edge-diffraction simulation operations described herein with respect to a (virtual) sound field at the listener position, as described herein. Specifically, the sound field may be represented both spectrally and spatially in an angular/parametric representation, such as a HOA representation. When representing the sound field as the HOA representation, the computer system may account for occlusion caused by a virtual object by applying a linear filter to the HOA representation to produce a target (occluded) sound field at the listener position.

For example, let a_nm(k) be the original (un-occluded) sound field at the listener position at spatial frequency $k=\Omega/c$, where $\Omega=2*\pi*f$ is the radial frequency and c is the speed of sound, and "n" and "m" represent the indices of the spherical harmonics order and modes of the sound field. Using the same nomenclature, let b_nm(k) be the target (occluded) sound field at the listener position. To determine b_nm(k), a spectral-spatial linear filter G_nm(k) representing a change in frequency and space due to the edge-diffraction caused by the virtual object introduced into the sound field may be applied to the original sound field, resulting in b_nm(k)–a_nm(k)*G_nm(k).

In one aspect, the edge-diffraction simulation operations described herein may be performed when representing the sound field in an angular/parametric representation. For instance, instead of (or in addition to) training the ML algorithm 23 to output filter parameters (e.g., the passband magnitude, etc.), the ML algorithm may be trained to output the spectral-spatial linear filter G_nm(k), based on either input parameters and/or a 2D image. In this case, upon outputting G_nm(k), the filter (e.g., 22) may apply the linear filter to the unoccluded sound field a_nm(k) to produce the occluded sound field b_nm(k). The spatial renderer may then render the occluded sound field for output through the speakers of the earphones 7 and 8.

Figure 6:
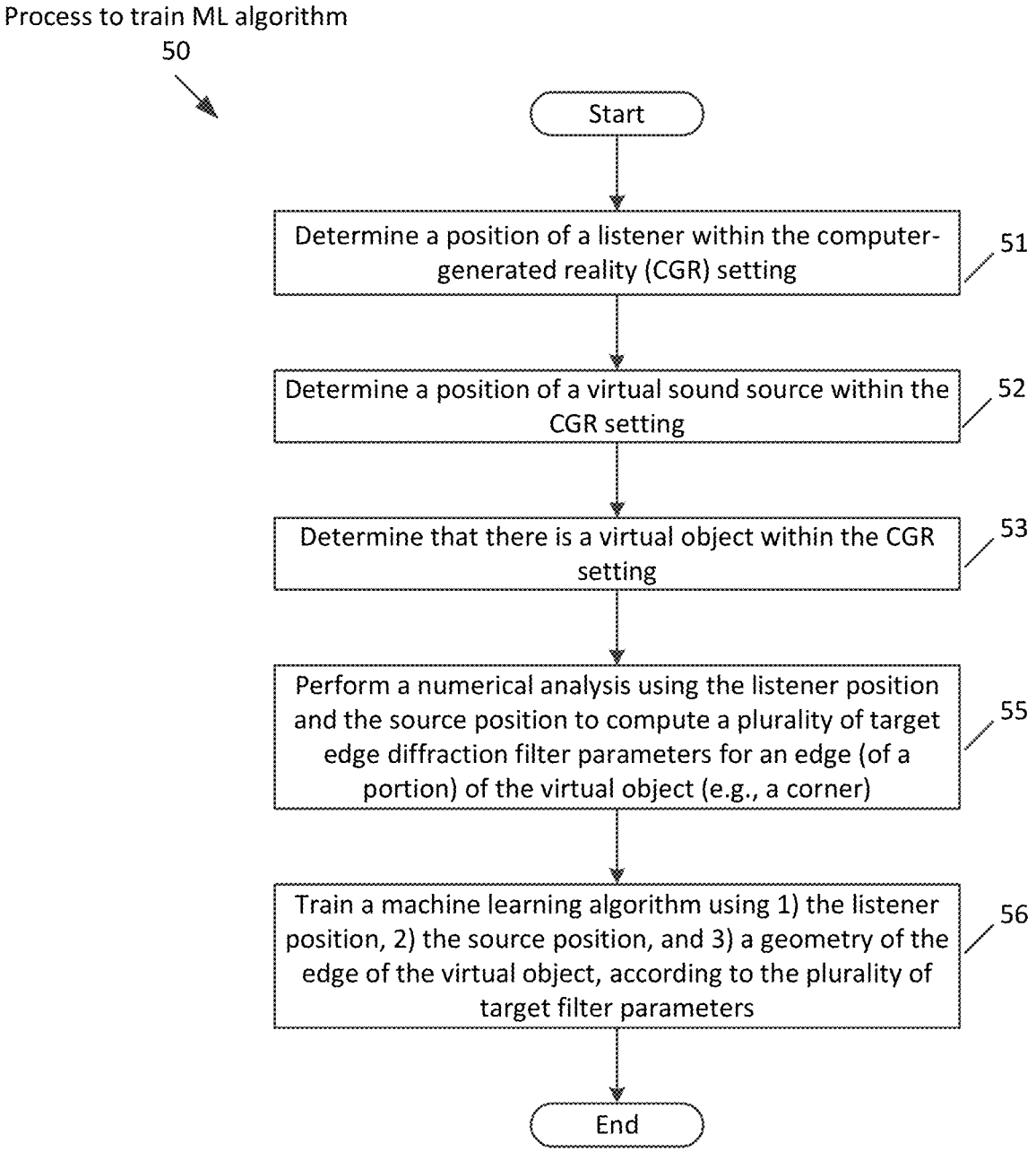
FIG. 6 is a flowchart of one aspect of a process to train a machine-learning algorithm of one aspect of the disclosure.

FIG. 6 is a flowchart of one aspect of a process 50 to train a ML algorithm (e.g., ML algorithm 21) of one aspect of the disclosure. In one aspect, at least a portion of the process 50 may be performed by the computer system (e.g., the sever). In another aspect, at least a portion of the operations may be performed in a controlled environment (e.g., in a laboratory) by a third-party CGR setting provider.

The process 50 begins by determining a position of a listener within the CGR setting (at block 51). The process 50 determines a position of a virtual sound source within the CGR setting (at block 52). The process 50 determines that there is a virtual object within the CGR setting (at block 53). The process performs a numerical analysis using the listener position and the source position to determine or compute a plurality of target edge-diffraction filter parameters (e.g., a passband magnitude, cutoff frequency, a roll-off slope, and/or a frequency response of a filter) for an edge (of a portion of) the virtual object, such as a corner. For instance, the process may perform any method to compute the target edge-diffraction filter parameters. In one aspect, the system may perform a numerical analysis for the edge of the virtual object using any known edge-diffraction model (e.g., BTM model). The process 50 trains a machine learning algorithm using 1) the listener position, 2) the source position, and 3) a geometry of the edge of the virtual object, according to the plurality of target edge-diffraction filter parameters (at block 56). In one aspect, the system may use any method to train the ML algorithm.

Figure 7:
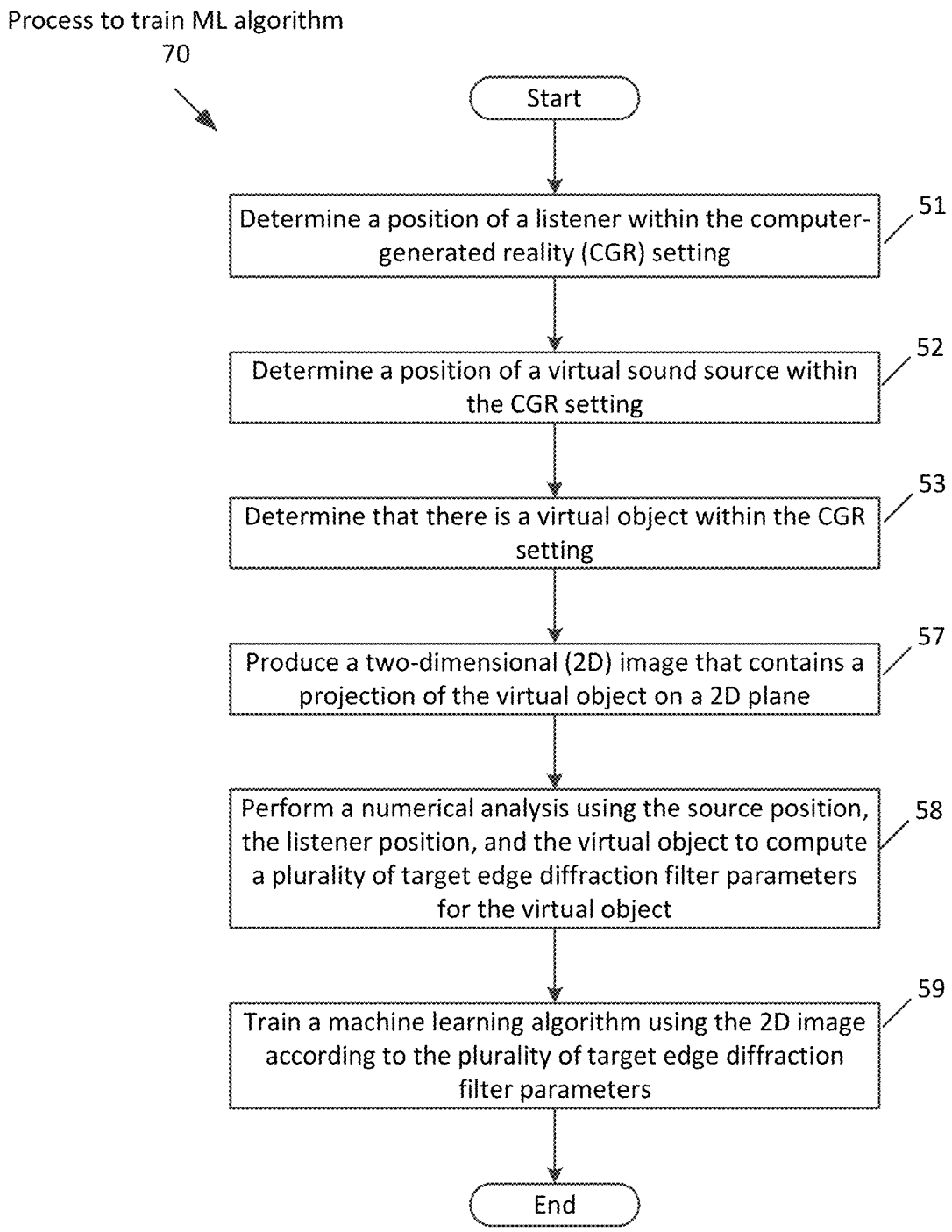
FIG. 7 is a flowchart of another aspect of a process to train a machine-learning algorithm of one aspect of the disclosure.

FIG. 7 is a flowchart of another process 70 to train a ML algorithm of another aspect of the disclosure. Similar to process 50 of FIG. 6, at least a portion of process 70 may be performed by the computer system.

The process 70 begins by performing similar operations as those described in FIG. 6. Specifically, the process determines a position of a listener (at block 51), determines a position of a virtual sound source (at block 52), and determines that there is a virtual object within the CGR setting (at block 53). The process 70, however, produces a 2D image that contains a projection of the virtual object on a 2D plane (at block 57). The process 50 performs a numerical analysis using the source position, the listener position, and the virtual object to compute several target edge diffraction filter parameters for the virtual object (at block 58). The process 50 trains the ML algorithm using the 2D image according to the several target edge diffraction filter parameters (at block 59). Specifically, the system uses the 2D image as input for the ML algorithm and the target edge diffraction filter parameters as expected output.

Some aspects perform variations of the processes described herein. For example, specific operations may not be performed in the exact order shown and described. The specific operations may not be performed in one continuous series of operations and different specific operations may be performed in different aspects. For instance, the object identifier/quantizer 40 may produce a 2D image of the 3D virtual object that just includes a 2D representation of the 3D object, without producing a quantized depth map. As another example, either of the processes 50 and 70 may not perform the operations of block 53.

In another aspect, the processes 50 and/or 60 may be performed to train the ML algorithm with respect to physical objects rather than (or in addition to) virtual objects. Thus, at least some of the operations, such as 53-59 in processes 50 and 60 may be performed to train the ML algorithm based on a determination that there is a physical object within the CGR setting.

An aspect of the disclosure may be a non-transitory machine-readable medium (such as microelectronic memory) having stored thereon instructions, which program one or more data processing components (generically referred to here as a "processor") to perform the edge-diffraction simulation operations, signal processing operations, and audio processing operations. In other aspects, some of these operations might be performed by specific hardware components that contain hardwired logic. Those operations might alternatively be performed by any combination of programmed data processing components and fixed hardwired circuit components.

While certain aspects have been described and shown in the accompanying drawings, it is to be understood that such aspects are merely illustrative of and not restrictive on the broad disclosure, and that the disclosure is not limited to the specific constructions and arrangements shown and described, since various other modifications may occur to those of ordinary skill in the art. The description is thus to be regarded as illustrative instead of limiting.

Personal information that is to be used should follow practices and privacy policies that are normally recognized as meeting (and/or exceeding) governmental and/or industry requirements to maintain privacy of users. For instance, any information should be managed so as to reduce risks of unauthorized or unintentional access or use, and the users should be informed clearly of the nature of any authorized use.

In some aspects, this disclosure may include the language, for example, "at least one of [element A] and [element B]." This language may refer to one or more of the elements. For example, "at least one of A and B" may refer to "A," "B," or "A and B." Specifically, "at least one of A and B" may refer to "at least one of A and at least one of B," or "at least of either A or B." In some aspects, this disclosure may include the language, for example, "[element A], [element B], and/or [element C]." This language may refer to either of the elements or any combination thereof. For instance, "A, B, and/or C" may refer to "A," "B," "C," "A and B," "A and C," "B and C," or "A, B, and C."

What is claimed is:

1. A method performed by a programmed processor of a computer system comprising an electronic device, the method comprising:

determining a listener position within a computer-generated reality (CGR) setting that is to be aurally experienced by a user of the electronic device through at least one speaker;

determining a source position of a virtual sound source within the CGR setting;

determining a characteristic of an object within the CGR setting, wherein the characteristic comprises a geometry of an edge of the object;

determining at least one edge-diffraction filter parameter for an edge-diffraction filter based on 1) the listener position, 2) the source position, and 3) the geometry of the edge of the object; and applying the edge-diffraction filter to an input audio signal to produce a filtered audio signal that accounts for edge diffraction of sound produced by the virtual sound source within the CGR setting.

2. The method of claim 1, wherein the geometry comprises a first side of the object and a second side of the object, wherein the first and second sides intersect at the edge, wherein determining the at least one edge-diffraction filter parameter comprises inputting at least one of 1) the listener position, 2) the source position, and 3) an angle from the first side to the second side about an axis that runs through the edge as input parameters into a machine-learning (ML) algorithm.

3. The method of claim 1, wherein the at least one edge-diffraction filter parameter comprises a cutoff frequency, a passband magnitude, and a roll-off slope.

4. The method of claim 3 further comprising determining the edge-diffraction filter according to the cutoff frequency, the passband magnitude, and the roll-off slope.

5. The method of claim 4, wherein the edge-diffraction filter is one of a low-pass filter, a high-pass filter, or an all-pass filter.

6. The method of claim 1 further comprising determining a spatial filter according to a path from the listener position to the edge; and using the spatial filter to spatially render the filtered audio signal to produce at least one spatially rendered audio signal that provides localization cues when outputted through the at least one speaker.

7. The method of claim 6, wherein, when the spatial filter is a head-related transfer function (HRTF), using the spatial filter to spatially render comprises binaural rendering the filtered audio signal according to the HRTF to produce a plurality of binaural audio signals for output through a left speaker and a right speaker.

8. The method of claim 7, wherein the electronic device is a head-mounted device (HMD) that comprises a left earphone that includes the left speaker and a right earphone that includes the right speaker.

9. The method of claim 8, wherein the HMD further comprises a display screen, wherein the method further comprises presenting the CGR setting by 1) displaying a visual representation of the CGR setting on the display screen and 2) using the plurality of binaural audio signals to drive respective speakers of the left and right earphones.

10. The method of claim 6, wherein the at least one speaker comprises two or more loudspeakers, wherein, when the spatial filter is a loudspeaker-based reproduction, using the spatial filter to spatially render comprises producing a set of spatially rendered audio signals according to the reproduction for driving the loudspeakers.

11. The method of claim 10, wherein the loudspeaker-based reproduction is one of a VBAP and a HOA.

12. An article of manufacture comprising a machine-readable medium having instructions stored therein that when executed by at least one processor of a computer system having an electronic device causes the computer system to determine a listener position within a computer-generated reality (CGR) setting that is to be aurally experienced by a user of the electronic device through at least one speaker;

determine a source position of a virtual sound source within the CGR setting;

determine a characteristic of an object within the CGR setting, wherein the characteristic comprises a geometry of an edge of the object;

determine at least one edge-diffraction filter parameter for an edge diffraction filter based on 1) the listener position, 2) the source position, and 3) the geometry of the edge of the object; and apply the edge-diffraction filter to an input audio signal to produce a filtered audio signal that accounts for edge diffraction of sound produced by the virtual sound source within the CGR setting.

13. The article of manufacture of claim 12, wherein the geometry comprises a first side of the object and a second side of the object, wherein the first and second sides interest at the edge, wherein instructions to determine the at least one edge-diffraction filter parameter comprises instructions to input at least one of 1) the listener position, 2) the source position, and 3) an angle from the first side to the second side about an axis that runs through the edge as inputs into a machine-learning (ML) algorithm.

14. The article of manufacture of claim 12, wherein the at least one edge-diffraction filter parameter comprises a cutoff frequency, a passband magnitude, and a roll-off slope.

15. The article of manufacture of claim 14, wherein the medium has further instructions to cause the system to determine the edge-diffraction filter according to the cutoff frequency, the passband magnitude, and the roll-off slope, wherein the edge-diffraction filter is one of a low-pass filter, a high-pass filter, or an all-pass filter.

16. The article of manufacture of claim 12, wherein the medium has further instructions to cause the system to determine a spatial filter according to a path from the listener position to the edge; and use the spatial filter to spatially render the filtered audio signal to produce at least one spatially rendered audio signal that provides localization cues when outputted through the at least one speaker.

17. The article of manufacture of claim 16, wherein, when the spatial filter is a head-related transfer function (HRTF), the instructions to use the spatial filter to spatially render comprises instructions to binaural render the filtered audio signal according to the HRTF to produce a plurality of binaural audio signals for output through a left speaker and a right speaker.

18. The article of manufacture of claim 17, wherein the electronic device is a head-mounted device (HMD) that comprises a left earphone that includes the left speaker and a right earphone that includes the right speaker.

19. A method performed by a programmed processor of a computer system comprising an electronic device, the method comprising:

determining a source position of a virtual sound source within a three-dimensional (3D) computer-generated reality (CGR) setting;

determining a listener position within the 3D CGR setting that is to be aurally experienced by a user of the electronic device through at least one speaker;

determining that a 3D virtual object is between the source position of the virtual sound source and the listener position;

producing a two-dimensional (2D) image that contains a projection of the 3D virtual object on a 2D plane;

determining at least one edge-diffraction filter parameter for an edge-diffraction filter according to the 2D image; and applying the edge-diffraction filter to an input audio signal to produce a filtered audio signal that accounts for edge diffraction of sound produced by the virtual sound source upon at least one edge of the 3D virtual object.

20. The method of claim 19, wherein producing the 2D image comprises producing a 2D depth map of the 3D virtual object by sampling the 2D image to produce a discrete space of the 2D image as a plurality of discrete samples; and for each of the samples, quantizing a thickness of a corresponding portion of the 3D virtual object in a z-axis that is perpendicular to the 2D plane to a value within a range of values.

21. The method of claim 20 further comprising determining, using a machine learning (ML) algorithm, a shortest path from the source position to the listener position and around the 3D virtual object according to the 2D depth map.

22. The method of claim 21 further comprising determining a spatial filter according to the shortest path; and using the spatial filter to spatially render the filtered signal to produce a spatially rendered signal for output through the speaker.

23. The method of claim 22, wherein, when the spatial filter is a head-related transfer function (HRTF), using the spatial filter to spatially render comprises binaural rendering the filtered audio signal according to the HRTF to produce a plurality of binaural audio signals for output through a left speaker and a right speaker.

24. The method of claim 22, wherein the at least one speaker are two or more loudspeakers, wherein, when the spatial filter is a loudspeaker-based reproduction, using the spatial filter to spatially render comprises producing a set of spatially rendered audio signals according to the reproduction for driving the loudspeakers.

25. The method of claim 19, wherein determining that the 3D virtual object is between the source position and the listener position comprises determining that at least a portion of the 3D virtual object is occluding a direct sound path from the source position to the listener position.

26. The method of claim 19, wherein the at least one edge-diffraction filter parameter comprises a cutoff frequency, a passband magnitude, and a roll-off slope.

* * * * *